US007165930B2

(12) United States Patent
Pisco

(10) Patent No.: US 7,165,930 B2
(45) Date of Patent: Jan. 23, 2007

(54) CO-OPERATIVELY ACTUATING THUMB APPARATUS

(75) Inventor: Walter J. Pisco, Mercer Island, WA (US)

(73) Assignee: Pasific Services & Manufacturing, Inc., Woodinville, WA (US)

( * ) Notice: Subject to any disclaimer, the term of this patent is extended or adjusted under 35 U.S.C. 154(b) by 0 days.

(21) Appl. No.: 11/031,337

(22) Filed: Jan. 6, 2005

(65) Prior Publication Data

US 2005/0220601 A1 Oct. 6, 2005

Related U.S. Application Data

(60) Provisional application No. 60/535,154, filed on Jan. 7, 2004.

(51) Int. Cl.
*B66C 1/00* (2006.01)

(52) U.S. Cl. ..... 414/729; 37/406

(58) Field of Classification Search ..... 414/724, 414/729, 912; 37/406
See application file for complete search history.

(56) References Cited

U.S. PATENT DOCUMENTS 4,375,345 A * 3/1983 Hanson ..... 414/722
6,120,237 A * 9/2000 Cummings et al. ..... 414/729
2003/0024138 A1* 2/2003 Frigon et al. ..... 37/406

* cited by examiner

*Primary Examiner*—Donald Underwood
(74) *Attorney, Agent, or Firm*—Stratton Ballew PLLC

(57) ABSTRACT

An actuated mechanical thumb apparatus is provided that pivots in compliment to the hinging of a bucket or similar hydraulically actuated attachment, as employed with conventional heavy equipment, such as backhoes and excavators. The thumb co-operatively actuates with the bucket to prevent walking or shifting of the gripped object. The thumb apparatus is unitized, or of a single component, well suited for easy retrofit to conventional material handling and earth moving equipment. The frame of the thumb apparatus mounts to a heavy equipment boom member or arm. The frame can be held in place on the boom member by two pins. The frame includes two frame plates, and the thumb includes two thumb plates. Each frame plate hingably attaches to one of the thumb plates at a separate pivot. This allows the thumb to pivot straddle the bucket's hinge, and pivot on the same axis as the bucket. A thumb link can be used across a pivoting bell crank, actuated by the thumb's hydraulic cylinder to actuate the thumb.

19 Claims, 16 Drawing Sheets

CO-OPERATIVELY ACTUATING THUMB APPARATUS

TECHNICAL FIELD

The invention relates to an actuated, mechanical thumb apparatus that is well suited for retrofit to a heavy equipment boom arm. The thumb apparatus pivots in compliment to the hinging of a bucket, scoop, or similar hydraulically actuated attachment, as employed with conventional heavy equipment, such as backhoes and excavators.

BACKGROUND OF THE INVENTION

Heavy equipment manufacturers typically employ hydraulic actuators to move and articulate arms, booms, buckets and auxiliary tools. These auxiliary tools can include hydraulically actuated attachments, such as scoops, fingers and grapples. All are employed with conventional backhoes and excavators. "Thumbs" are another articulating auxiliary tool often used with a bucket. The thumb is typically employed to grasp larger objects, such as tree trunks or boulders.

Examples of such thumbs are found in U.S. Pat. No. 6,640,471 to Desrochers, which shows a thumb and bucket combination. The thumb attaches to a boom arm of an excavator or other earth moving equipment, near a pivoting bucket. The thumb may be added to the arm as a retrofit. However, this requires the permanent attachment of a large mounting bracket to the arm, and the attachment of extension plates to the bucket. The forces involved in the operation of the thumb places significant mechanical stresses on these extension plates. Additionally, the thumb's pivot is separated from the bucket's pivot by a suggested distance of about eight inches. This separation is typical of several prior retrofit thumb pivots, all unable to coincide, or line-up with the bucket pivot. A closer attachment is not feasible.

U.S. Pat. No. 5,111,602 to Risch, and U.S. Pat. No. 5,553,408 to Townsend teach extensive thumb retrofits requiring that the hinge pin of the bucket be lengthened, allowing a direct attachment of the thumb to the extended pin. This direct attachment provides for an improved gripping action by the thumb, without walking or rotating of the grasped object as the thumb and bucket rotate together. However, it is observed that the bucket pin is difficult to remove and replace with the needed precision. With this cumbersome modification of the bucket pivot to accommodate the thumb pivot, these prior thumbs are very difficult to properly install.

Therefore, a retrofit thumb for use with heavy equipment is needed that is easy to attach and detach from an arm or boom, and cooperatively actuates with an existing bucket to eliminate walking of the grasped object.

Additionally, these prior actuated thumb retrofits fail to account for the added stresses incurred to the boom mechanism and bucket. Therefore, a thumb apparatus is needed that can attach to a heavy equipment boom member quickly and economically, without requiring a refitting of the bucket pivot, strengthening or "beefing up" the boom member, or any such major changes to the structure, design or configuration of the boom member, the bucket, or the heavy equipment to which the thumb apparatus is mounted.

The present invention addresses these shortcomings of prior thumbs and will be better understood by reference to the following detailed description taken in conjunction with the accompanying drawings.

DETAILED DESCRIPTION OF SPECIFIC EMBODIMENTS

The invention provides an apparatus for a co-operatively actuating thumb apparatus for use with heavy equipment. Preferably, the thumb apparatus is "unitized" or of a single component, and so is well suited for easy retrofit to conventionally articulated material handling and moving equipment, such as powered backhoes and excavators. More particularly, the invention includes a mechanically actuated thumb apparatus that pivots to complement the hinging motion of a bucket or similar hydraulically actuated device. Buckets, and similar hydraulically actuated attachments include scoops, fingers and grapples, as employed with conventional backhoes and excavators.

Figure 5:
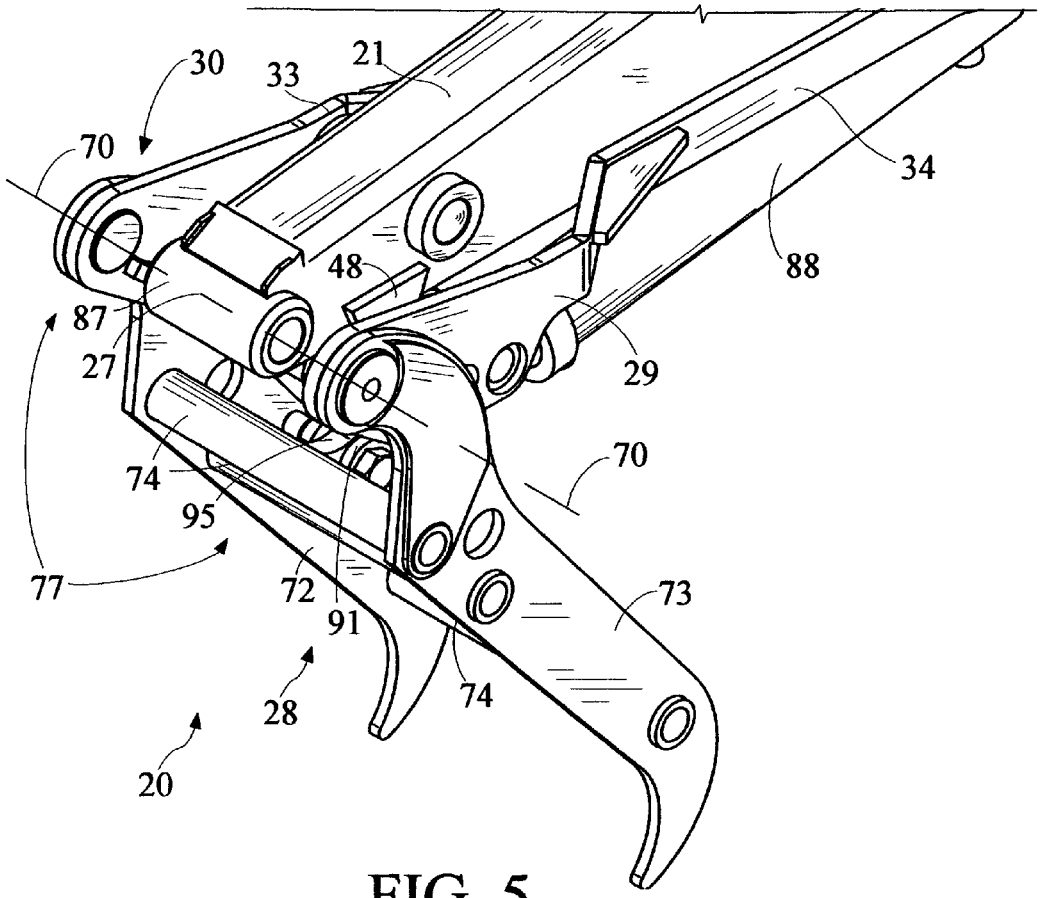
FIG. 5 is a partial perspective view of a thumb apparatus mounted to a boom member, according to an embodiment of the invention.
Figure 6:
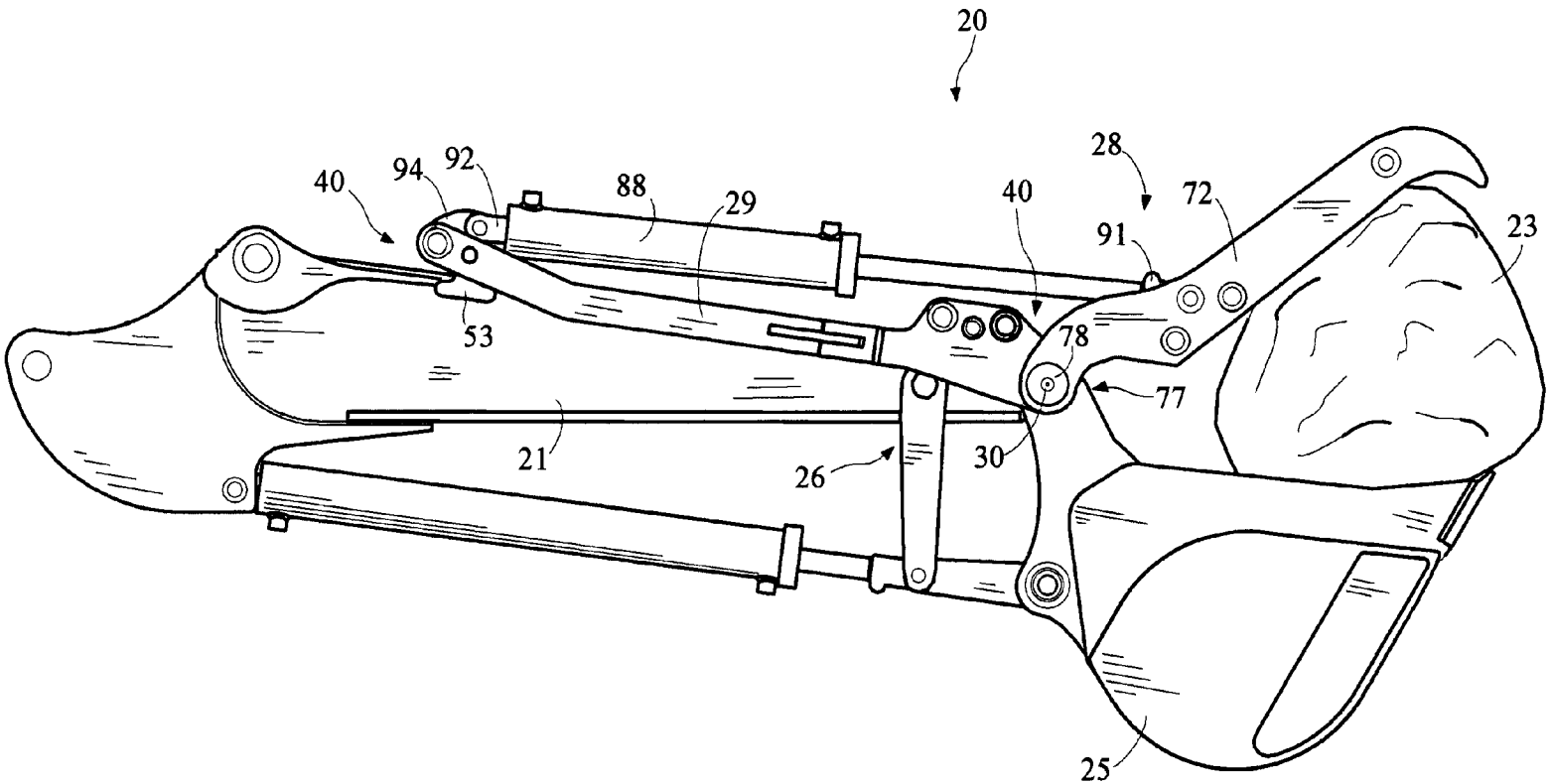
FIG. 6 is a side view of a thumb apparatus, mounted to a boom member and gripping a load, according to an embodiment of the invention.
Figure 7:
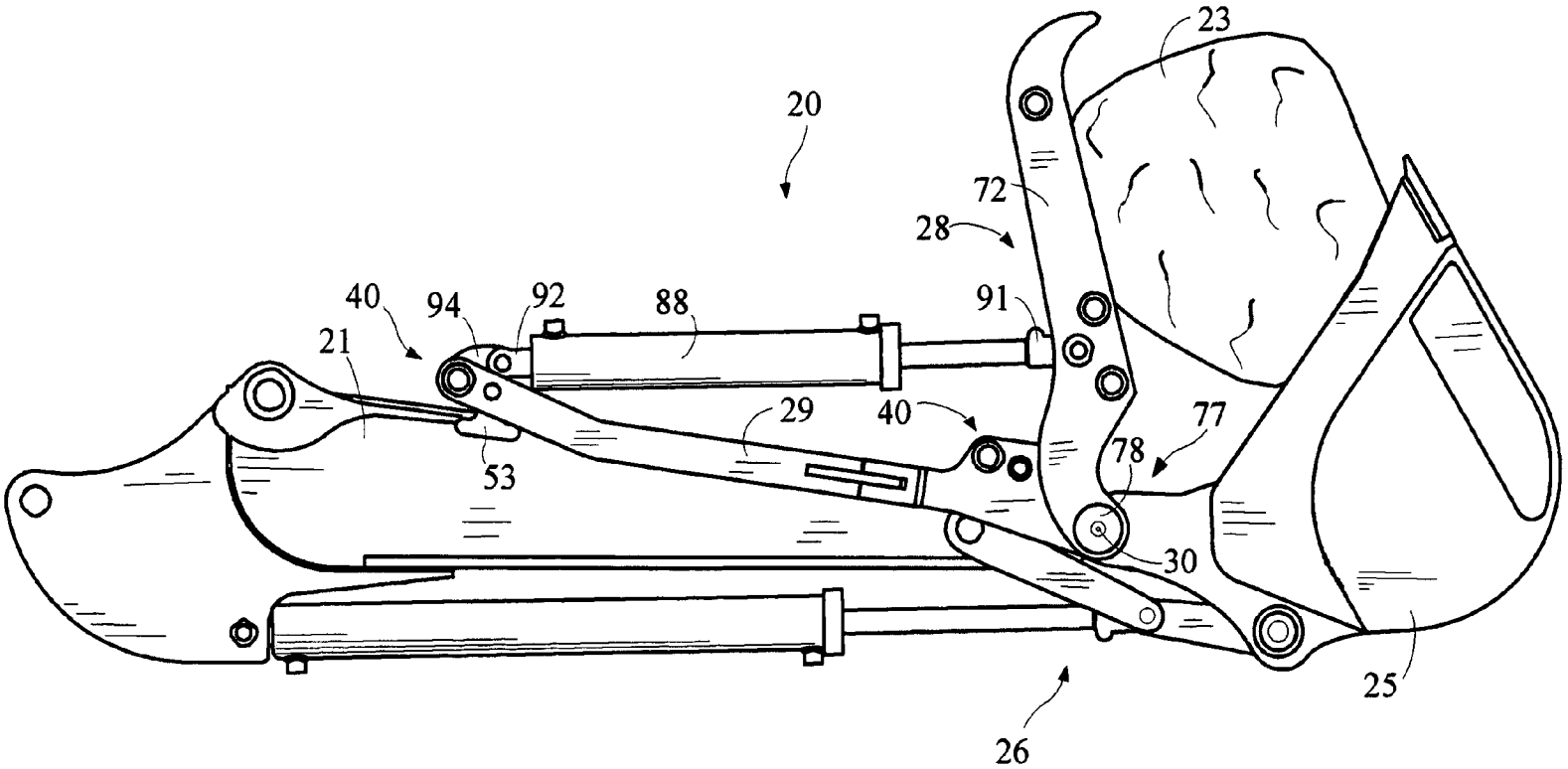
FIG. 7 is a side view of a thumb apparatus, mounted to a boom member and gripping a load, according to an embodiment of the invention.
Figure 14:
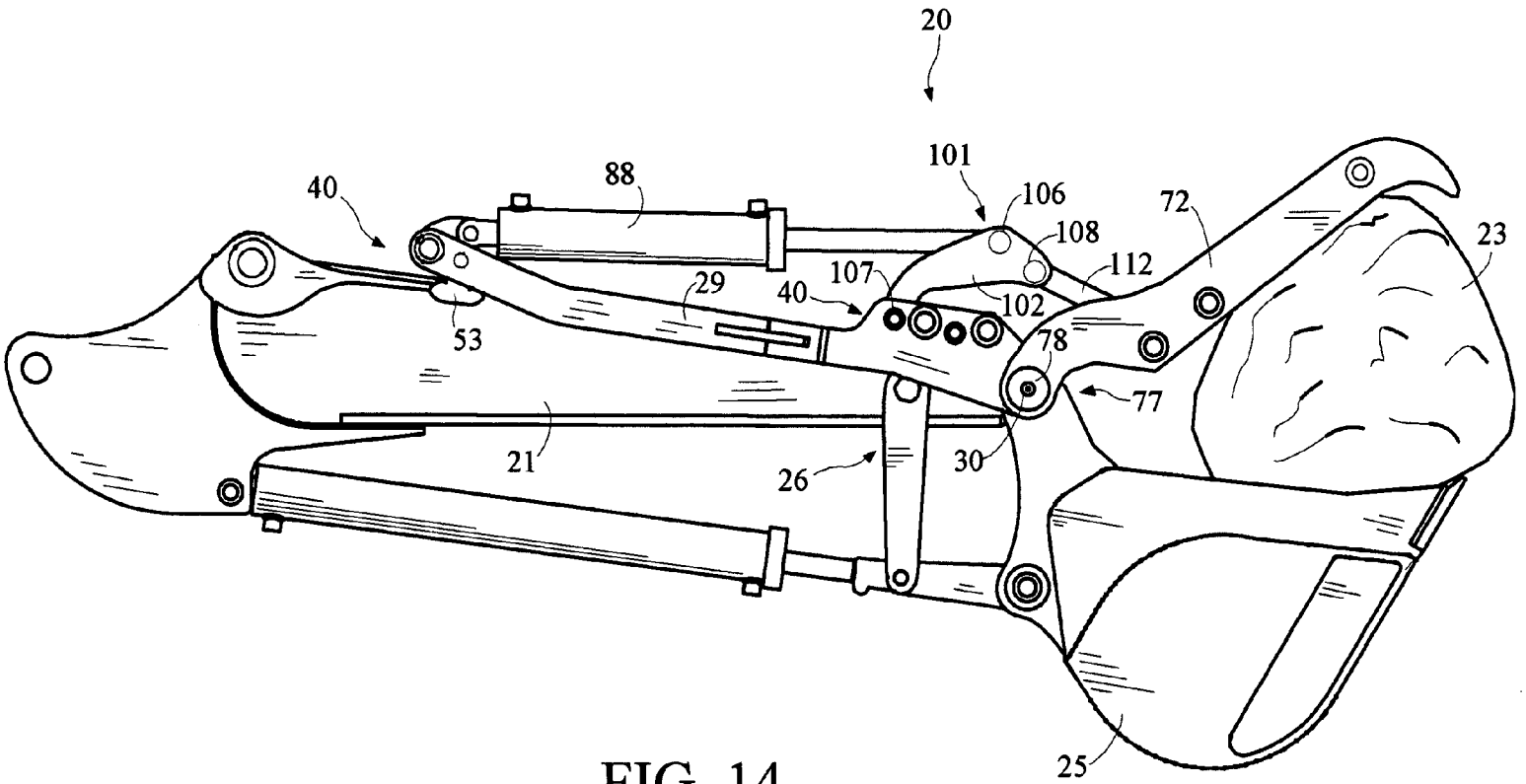
FIG. 14 is a side view of a thumb apparatus, mounted to a boom member and gripping a load, according to an embodiment of the invention.
Figure 15:
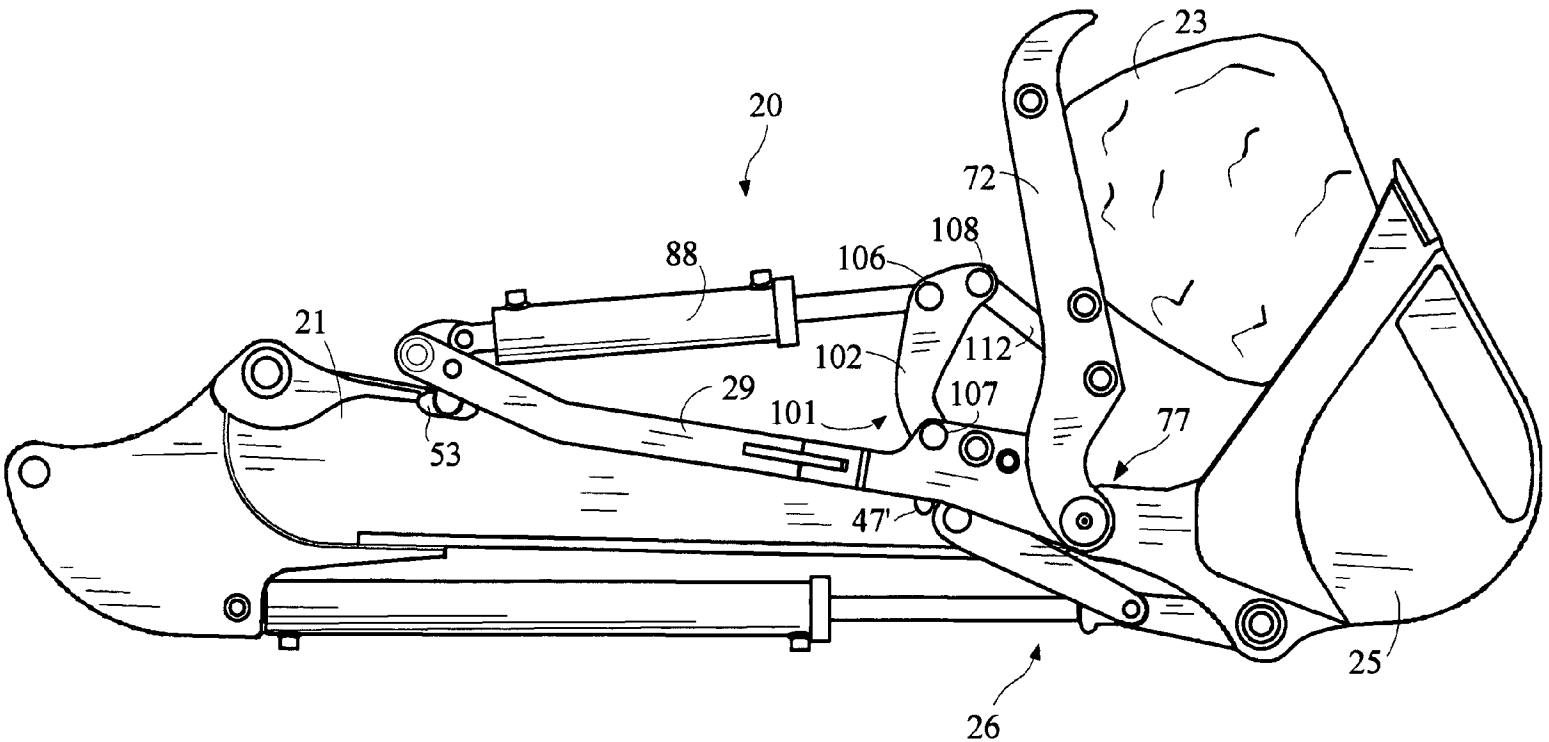
FIG. 15 is a side view of a thumb apparatus, mounted to a boom member and gripping a load, according to an embodiment of the invention.

Preferred embodiments of the thumb apparatus 20 of the present invention are shown in FIGS. 1 through 16. The thumb apparatus mounts to a boom member 21. The boom member is an articulated appendage hingably attached to a conventional backhoe, excavator or similar mechanized heavy equipment 22. Especially in backhoe applications, the heavy equipment boom member may be referred to as a "dipper arm." FIGS. 6 and 7 shows a preferred embodiment of the present invention with a gripped load 23. FIGS. 14 and 15 show an alternative preferred embodiment of the present invention with the gripped load.

As is conventional, the boom member 21 terminates with a bucket 24. The bucket connects to the boom member at a bucket pivot 25. The bucket pivot is part of a bucket linkage system 26, which is typical of most of the mechanized heavy equipment 22 that include such buckets. The bucket pivot rotates the bucket on the boom member, about a bucket pivot axis 27. As discussed in the background section above, without extensive retrofitting, present mechanical thumb systems are unable to hinge about the bucket pivot. This separation of the bucket pivot axis from the thumb pivot axis creates undesirable "walking" or rotational movement, under the parallel action of the thumb and bucket upon the gripped load 23.

As detailed in FIGS. 3, 4, 12 and 13, preferred embodiments of the thumb apparatus 20 includes a thumb 28, hingably attached to a thumb mount frame 29, at a thumb pivot 30. The thumb mount frame has a front frame end 31 located proximate to the thumb pivot, and a rear frame end 32, located at the opposite end of the thumb mount frame, relative to the thumb pivot. The thumb mount frame includes a first frame plate 33 positioned opposite a second frame plate 34. The first frame plate has a first front frame end 36, and a first back frame end 37. The second frame plate has a second front frame end 38, and a second rear frame end 39.

Figure 3:
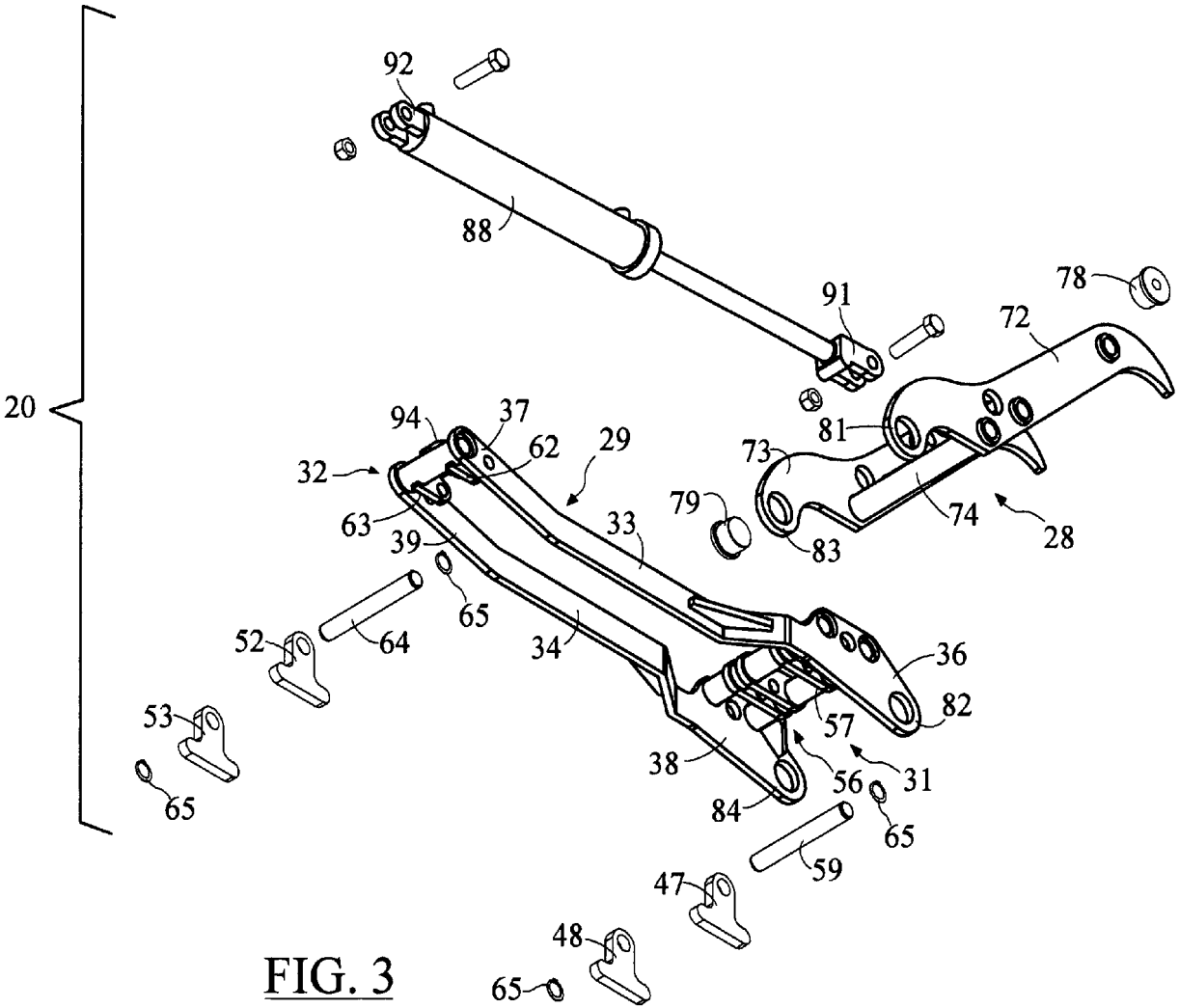
FIG. 3 is an exploded perspective view of a thumb apparatus, according to an embodiment of the invention.
Figure 4:
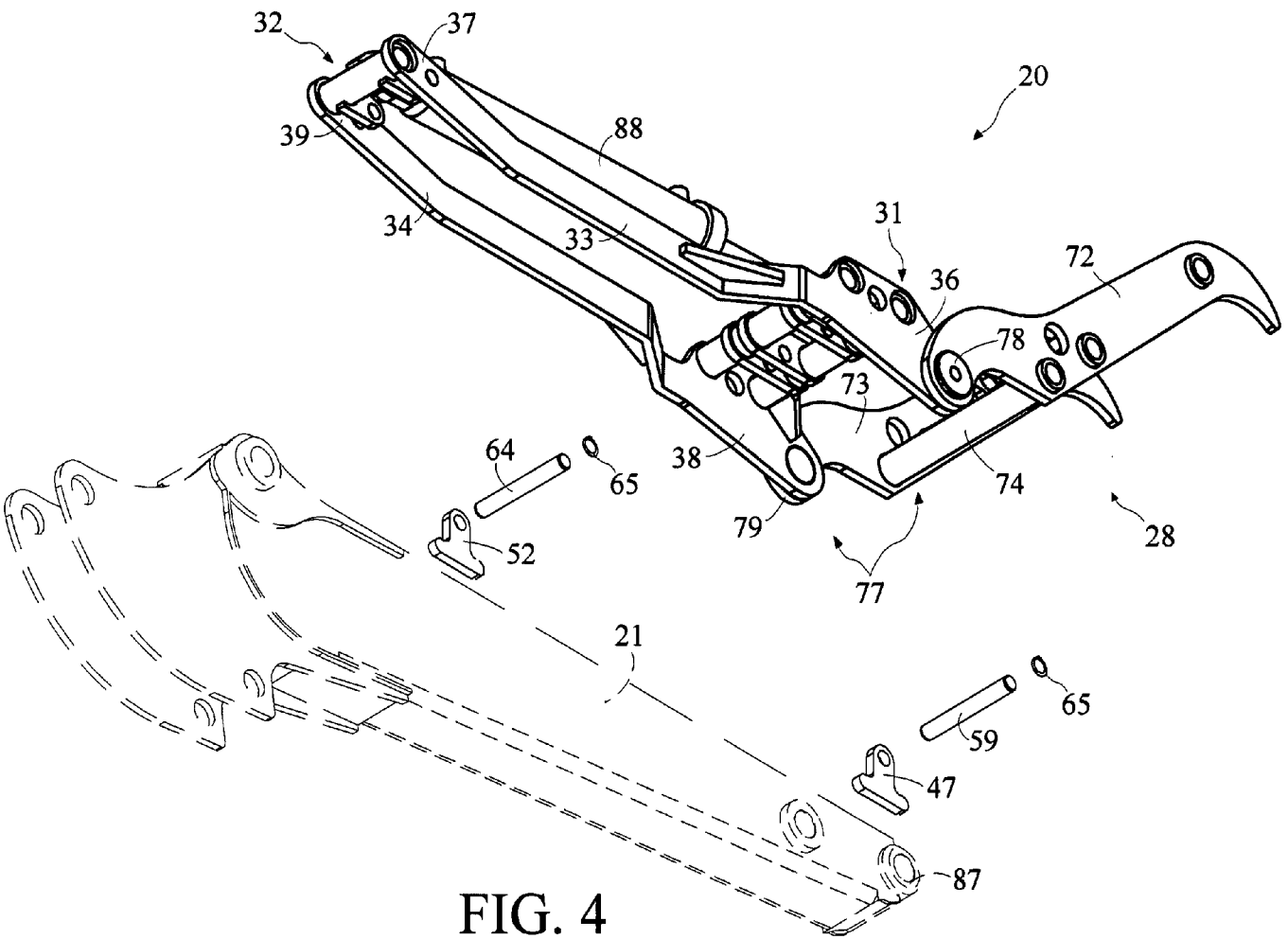
FIG. 4 is a partially exploded perspective view of a thumb apparatus, according to an embodiment of the invention.
Figure 12:
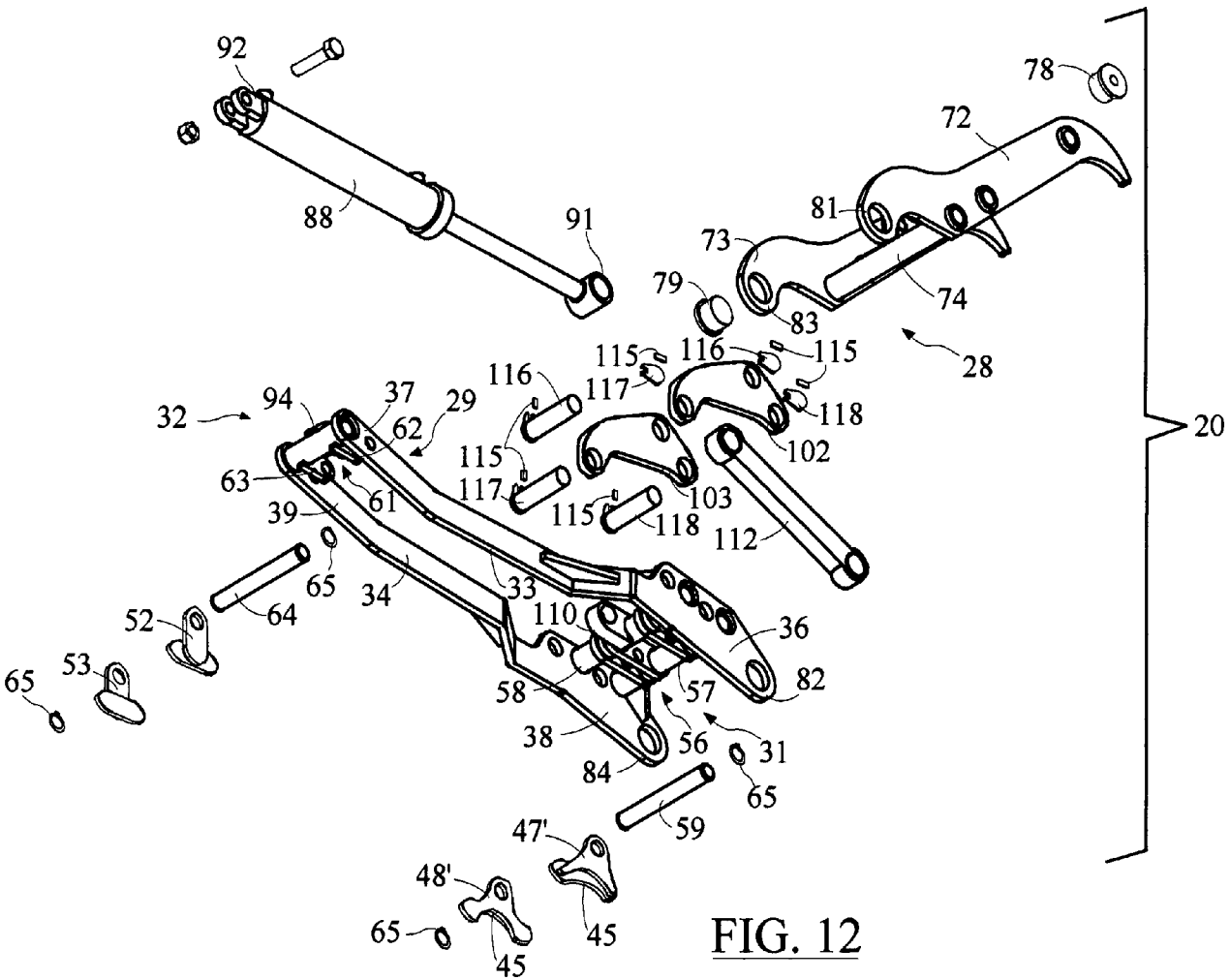
FIG. 12 is an exploded perspective view of a thumb apparatus, according to an embodiment of the invention.
Figure 13:
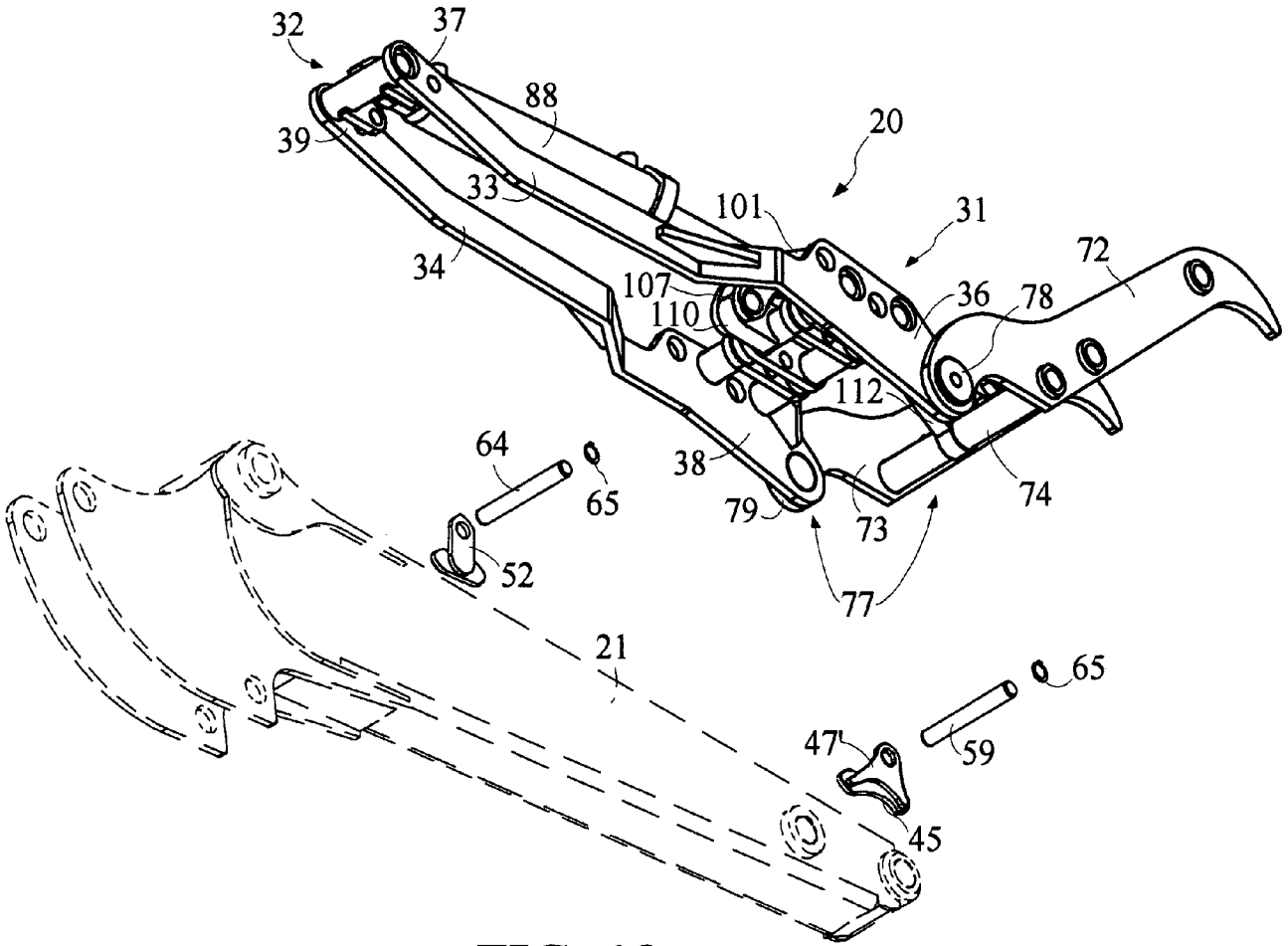
FIG. 13 is a partially exploded perspective view of a thumb apparatus, according to an embodiment of the invention.

The first frame plate 33 and the second frame plate 34 are mounted to the boom member 21. Preferably, the mounting of the thumb mount frame 26 to the boom member is achieved by a detachable mount 40. The detachable mount preferably includes a front mount 43 and a rear mount 44. As shown in FIG. 3, the front mount most preferably includes a first front mounting ear 47, which is welded to the boom member and positioned opposite a second front mounting ear 48, also welded to the boom member. As shown in FIG. 12, the first front mounting ear can be an alternative first front mounting ear 47', which includes an inset 45 to accommodate a bucket pivot 46, as shown in FIG. 14. Opposite the alternative first front mounting ear, an alternative second front mounting ear 48' can be used in the place of the second front mounting ear. As shown in FIG. 12, the alternative second front mounting ear also includes an inset to accommodate the bucket pivot.

Similar to the front mount 43, the rear mount 44 most preferably includes a rear front mounting ear 52, which is welded to the boom member 21 and positioned opposite a second rear mounting ear 53, also welded to the boom member. For the mounting ears, welding is the most preferred type of attachment. However, in the alternative, any equivalent attachment means as would be used by a person skilled in equipment mounting and attachment could be employed, such as bolts, clamps, or rivets. Also, as an additional preferred attachment, the boom member could be manufactured with the mounting ears integral to the structure of the boom member.

To complete the front mount 43 of the detachable mount 40, the thumb mount frame 26 preferably includes a front mounting bracket 56. The front mounting bracket most preferably includes a first front bracket 57 and a second front bracket 58. A front mounting pin 59 is received through the front mount to engage the first front mounting ear 47 or alternatively 47' within the first front bracket, and the second front mounting ear 48 or alternatively 48' within the second front mounting bracket.

Similarly, to complete the rear mount 44 of the detachable mount 40, the thumb mount frame 26 preferably includes a rear mounting bracket 61. The rear mounting bracket most preferably includes a first rear bracket 62 and a second rear bracket 63. A rear mounting pin 54 is received through the rear mount to engage the first rear mounting ear 52 within the first rear bracket, and the second rear mounting ear 53 within the second rear mounting bracket.

The front mounting pin 59 and the rear mounting pin 64 may be held in place by any means known to persons skilled in the secure attachment of dowels and pins. Most preferably, a retaining ring 65 is employed at each of both mounting pins, as shown in FIGS. 3 and 12. In a less preferred alternative, cotter pins, bolts or threaded receivers of conventional design could be employed to secure the mounting pins. With the retaining rings, the front mounting pin is secured at each end to maintain the front mounting pin within the first front bracket 57 and the second front bracket 58, thereby forming the front mount 43. Likewise, with use of the retaining rings, the rear mounting pin 64 is secured at each end to maintain the rear mounting pin within the first rear bracket 62 and the second rear bracket 63, thereby forming the rear mount 44.

The thumb apparatus 20 is attachable and detachable as a unit. To remove the thumb frame 29, the front mounting pin 59 is extracted from the front mounting bracket 56, and the rear mounting pin 64 is extracted from the rear mounting bracket 61. The mounting pins are free to be extracted after the removal of one of the retaining rings 65 from each pin. After removal of the mounting pins and the mount frame, the first front mounting ear 47, the second front mounting ear 48, the first rear mounting ear 52, and the second rear mounting ear 53, can all remain attached to the boom member 21, for future re-attachment of the thumb frame, if desired.

The front mount 43 of the thumb mount frame 26 is located proximate to the thumb pivot 30. As detailed in FIGS. 4, 5 and 13, the thumb apparatus 20 includes the thumb 28, hingably attached to the thumb mount frame 29, at the thumb pivot 30. For the present invention, the thumb pivot includes a first thumb pivot 68 paired opposite a second thumb pivot 69. The first and second thumb pivots both rotate about a thumb pivot axis 70, common to both thumb pivots.

Figure 8:
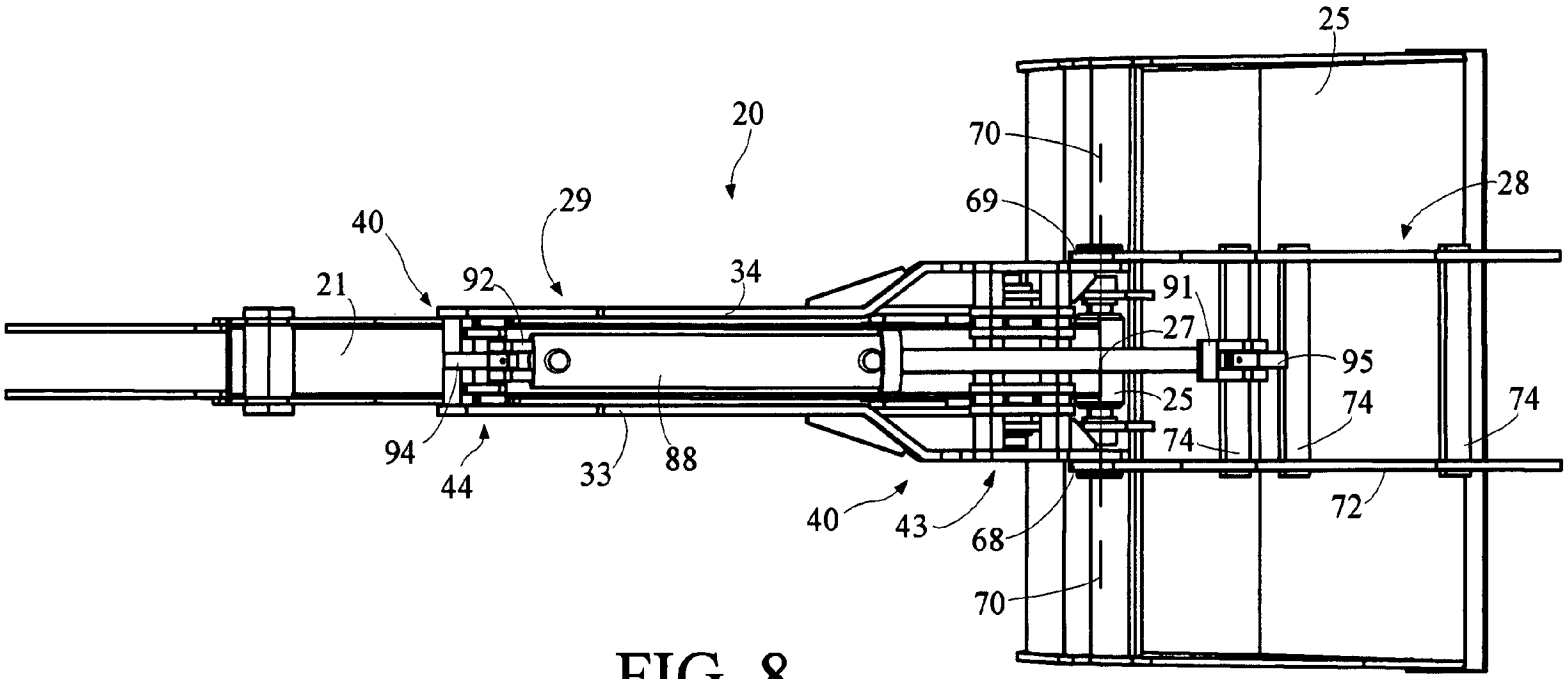
FIG. 8 is a top view of a thumb apparatus mounted to a boom member, according to an embodiment of the invention.
Figure 9:
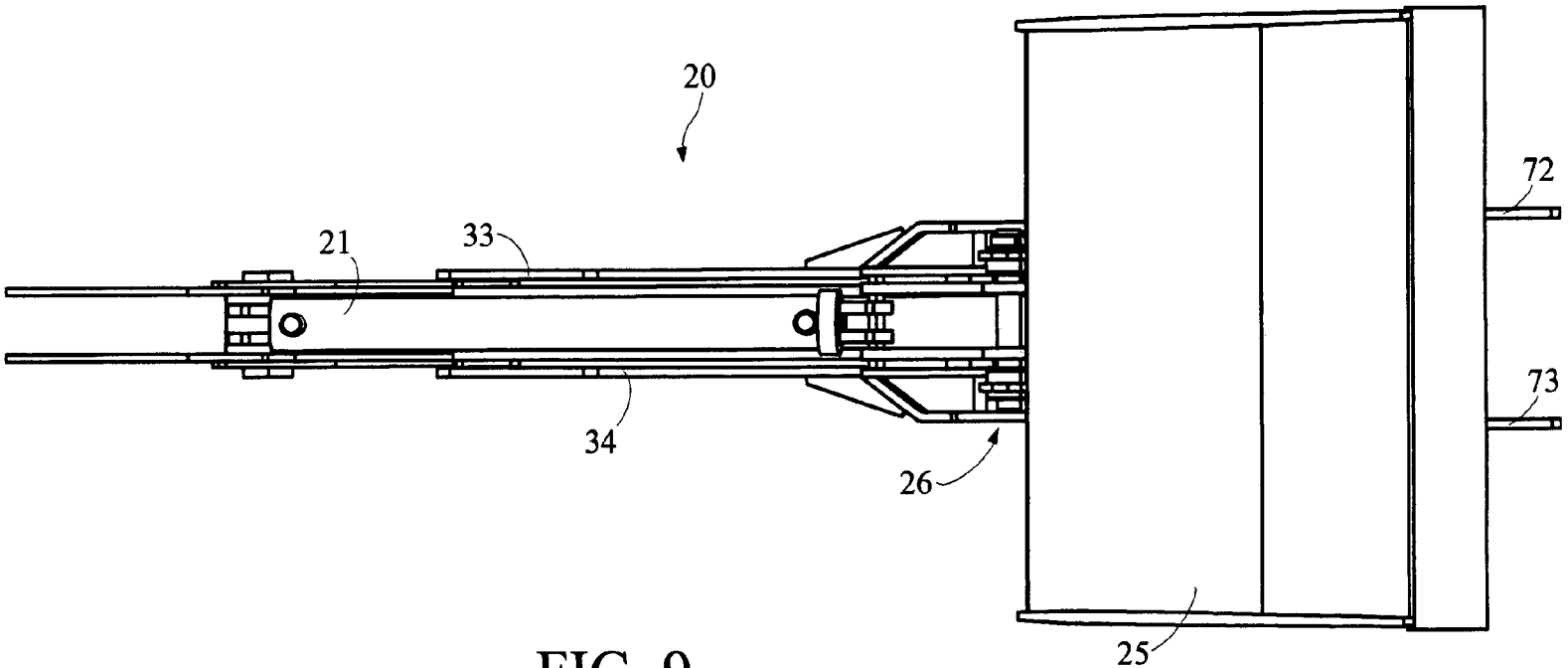
FIG. 9 is a bottom view of a thumb apparatus mounted to a boom member, according to an embodiment of the invention.
Figure 10:
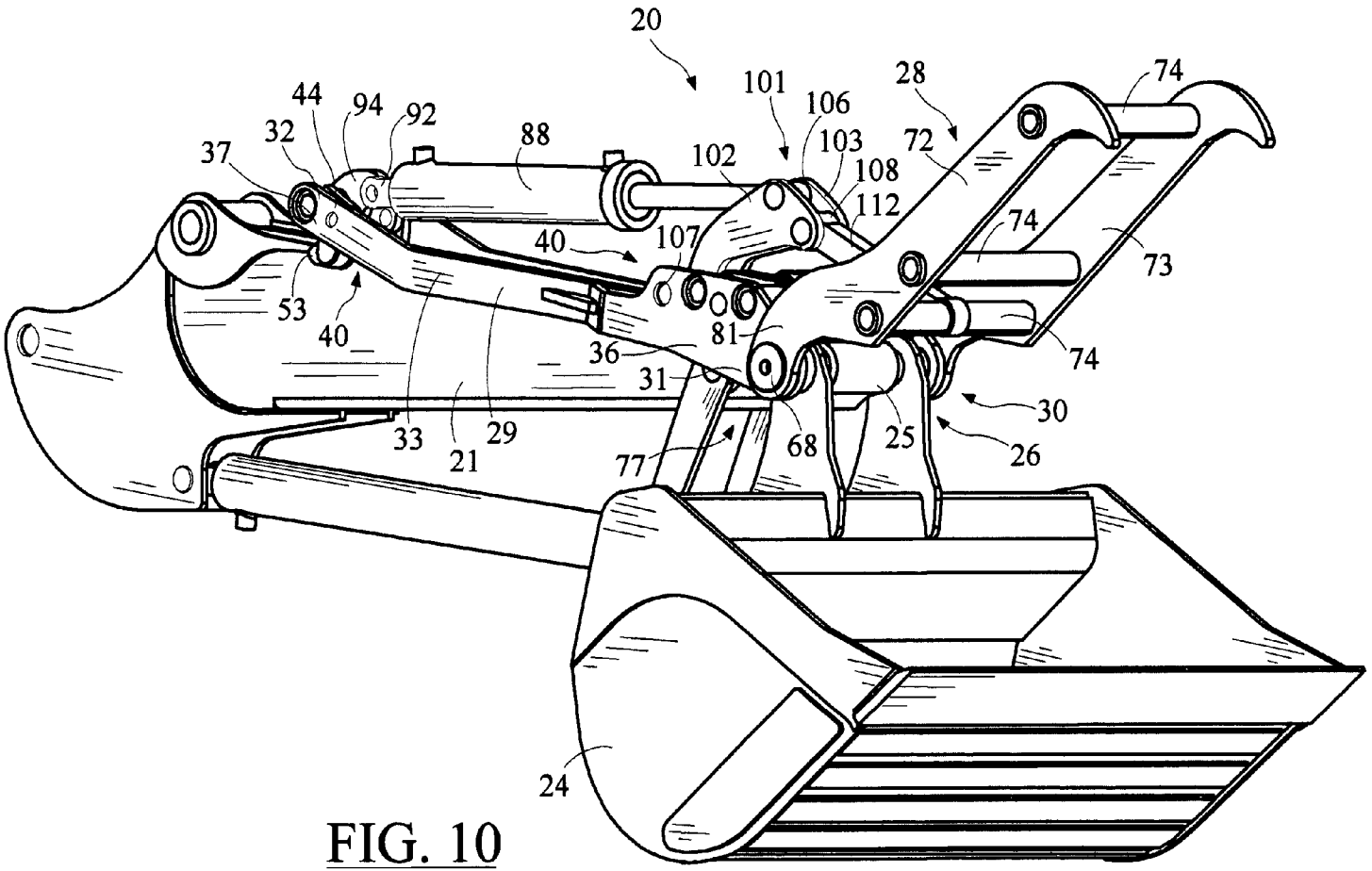
FIG. 10 is a perspective view of a thumb apparatus mounted to a boom member, according to an embodiment of the invention.
Figure 16:
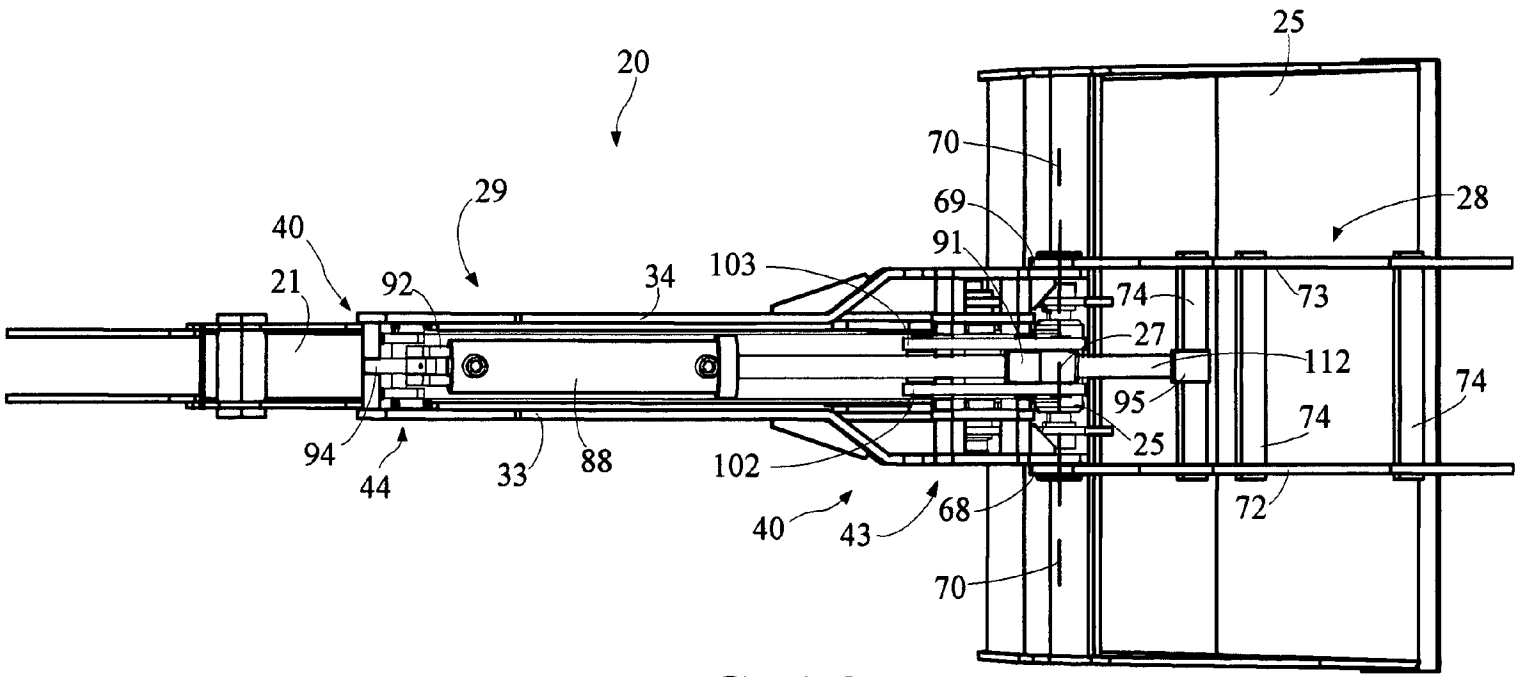
FIG. 16 is a top view of a thumb apparatus mounted to a boom member, according to an embodiment of the invention.

The thumb 28 most preferably includes a first thumb plate 72 and a second thumb plate 73 interconnected by one or more of a thumb plate link 74. The thumb plate links separate the thumb plates in a parallel relationship. The thumb plate links are preferably cylindrical, hollow tubes formed of a steel with sufficient strength to resist deformation under gripping pressures by the thumb. Most preferably, as shown in FIGS. 8 and 16, three thumb plate links are employed. However, any appropriate number of the thumb plate links could be used in alternative embodiments of the present invention. Also alternatively, one or more joining members as a person skilled in thumb manufacture would utilize, such as flat bars, angled bars, rods or channel stock, could be used instead of the thumb plate links.

The first thumb pivot 68 is the hinged attachment of the first thumb plate 72 to the first frame plate 33, near the first front frame end 36 of the first frame plate. Similarly, the second thumb pivot 69 is the hinged attachment of the second thumb plate 73 to the second frame plate 34, near the second front frame end 38 of the second frame plate.

Most preferably, the first thumb pivot 68 and the second thumb pivot 69, both employ a trunnion pivot mechanism 77, to form the thumb pivot 30. As shown in FIGS. 3, 4, 5, 12 and 13, the trunnion pivot mechanism preferably includes a first trunnion 78 and a second trunnion 79. To form the first thumb pivot 68, the first trunnion is held within a first thumb bearing 81 on the first thumb plate 72, and a first frame bearing 82 on the first frame plate 33. To form the second thumb pivot 69, the second trunnion is held within a second thumb bearing 83 on the second thumb plate 73, and a second frame bearing 84 on the second frame plate 34.

The first thumb pivot 68 and the second thumb pivot 69, both hinge about the thumb pivot axis 70. For the present invention, the thumb pivot axis approximately collocates with the bucket pivot axis 27. The term "approximately" is used in this description as pertaining to departures from exact collocation of the thumb pivot axis and the bucket pivot axis, which still function similarly to the elements described herein, with the advantages made possible by the structure of the present invention.

Additionally, other pivot mechanisms are certainly considered for use as an alternative to the preferred trunnion pivot mechanism 77. The thumb pivot 30 could certainly be formed from a first thumb pivot 68 and a second pivot 69 of any one of several conventional pivot mechanisms known to those skilled in the design and manufacture of hinges in heavy equipment 22. However, the trunnion pivot mechanism is ideal for use in the present invention and is a most preferred pivot mechanism. With the trunnion pivot mechanism, the first and second thumb pivots can be brought in close proximity to the bucket pivot 25, as shown in FIGS. 5, 8 and 16, and so "line-up" or collocate the thumb pivot axis 70 with the bucket pivot axis 27. The thumb pivot straddles the bucket pivot, and so hinges on the same axis as the bucket.

No other retrofit thumb pivot has the ability to closely approximate, or coincide with the bucket pivot 25, as accomplished with the thumb pivot 30 of the present invention. Specifically, as is typical, the bucket pivot includes a bucket pin 85. The bucket pin is received into an arm bearing 86 on the boom member 21, and a bucket bracket 87 on the bucket 24, to form the bucket pivot. In retrofitting the thumb apparatus 20 of the present invention, the thumb mount frame 29 can be attached to the boom member quickly and economically, without requiring a refitting or replacement of the bucket pin or any part of the exiting bucket. The thumb apparatus retrofit does not require a "beefing up" or strengthening of the boom member, or any such significant changes to the structure, design or configuration of the boom member, the bucket, or the heavy equipment to which the thumb apparatus is mounted.

The thumb 28 preferably actuates about the thumb pivot 30 by the action of a thumb cylinder 88. The thumb cylinder is most preferably a conventional hydraulically actuated piston and cylinder combination, as typically employed in heavy equipment 22. The thumb cylinder is actuated under the control of the operator of the heavy equipment. Alternatively, the thumb cylinder could be operated remotely, or powered by alternative methods, such as pneumatic pressure, gears or transmissions. The hydraulic system of the heavy equipment is typically well suited to add the additional, conventional controls and fluid routing needed for the thumb cylinder. As an alternative to the actuator, a static support could be employed. Such a support could be adjustable to varying lengths, as needed to set the thumb at a desired pivot position.

Figure 1:
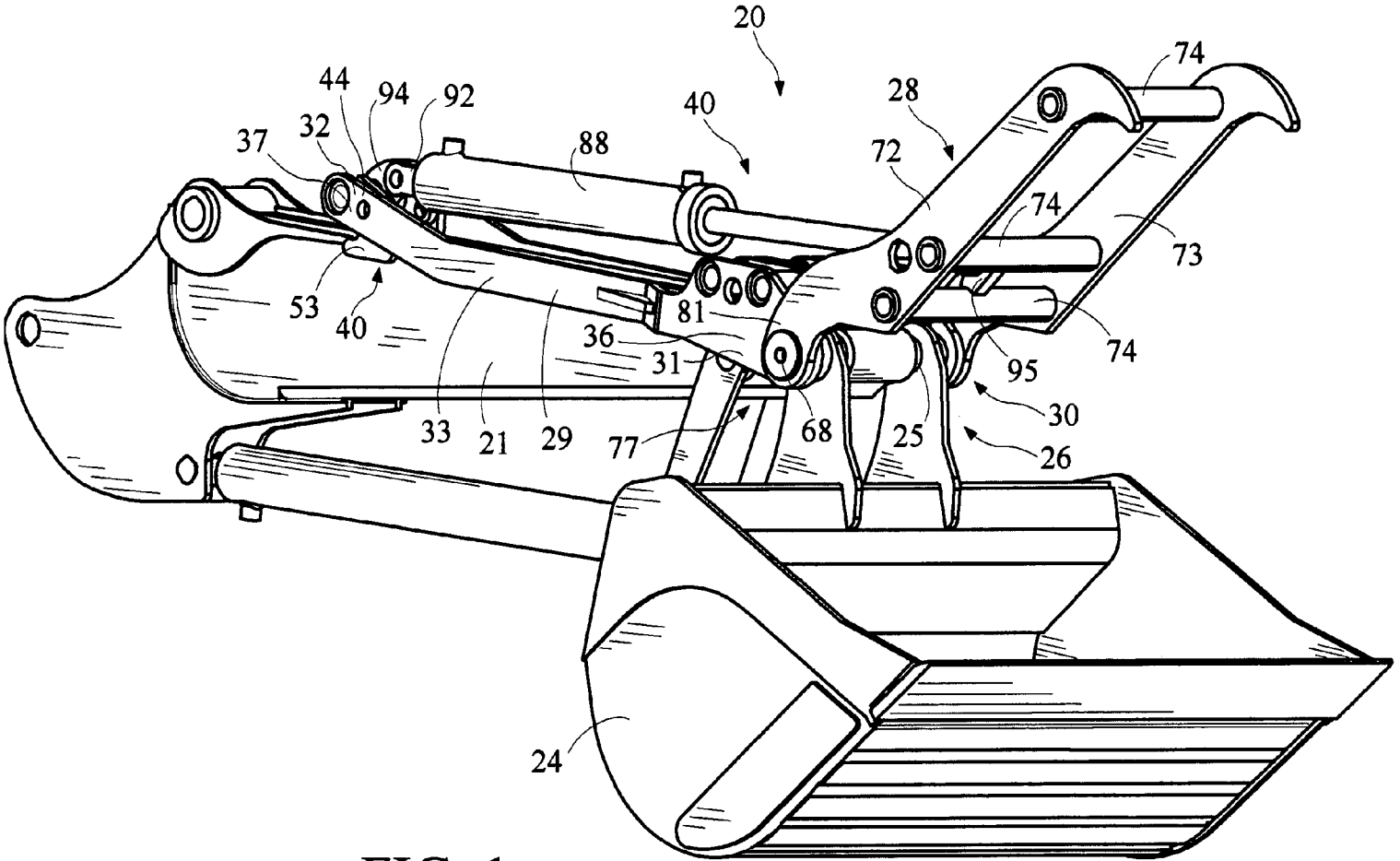
FIG. 1 is a perspective view of a thumb apparatus mounted to a boom member, according to an embodiment of the invention.
Figure 2:
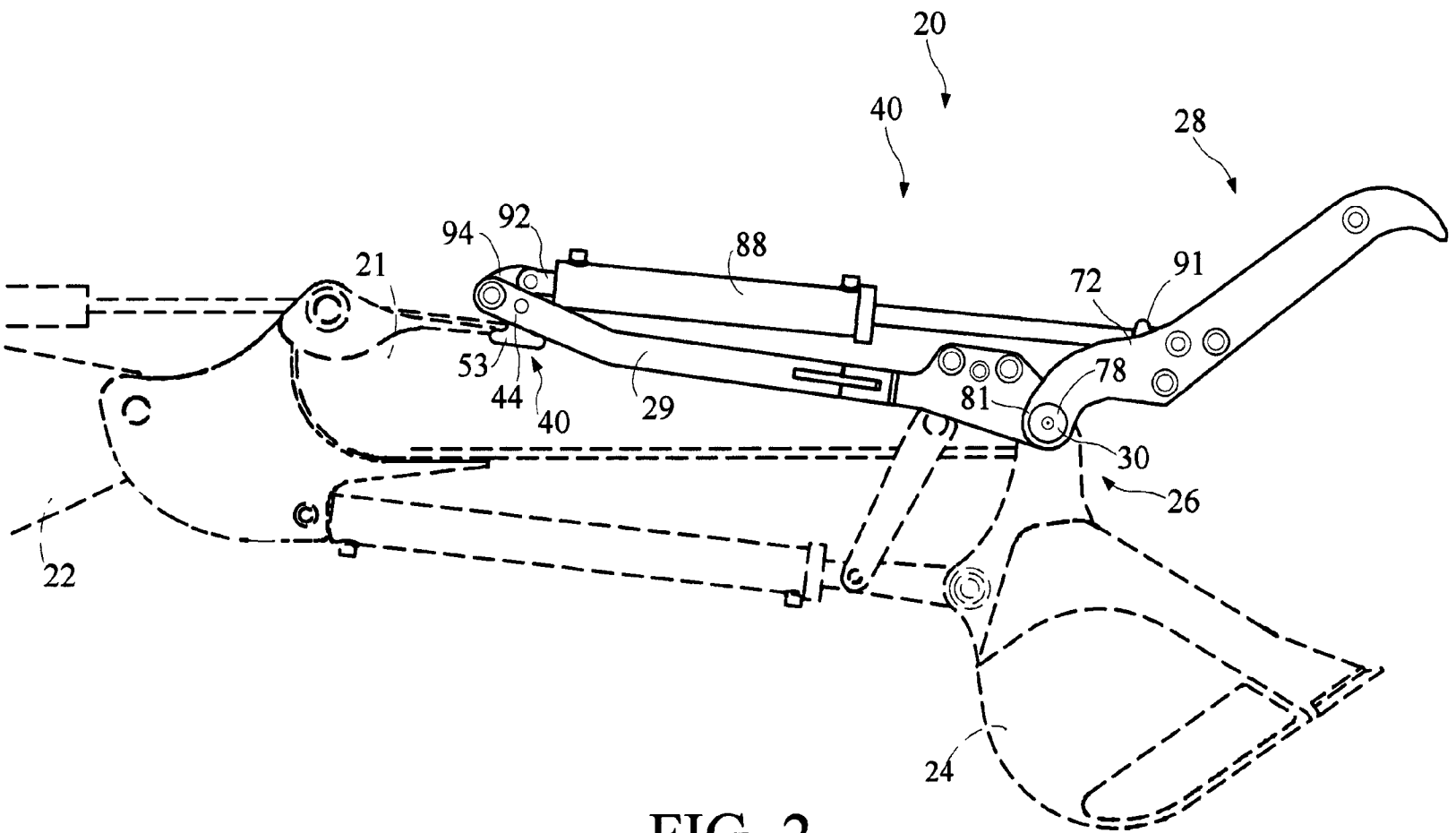
FIG. 2 is a side view of a thumb apparatus, according to an embodiment of the invention.

In a preferred embodiment of the present invention as shown in FIGS. 2 and 3, the thumb cylinder 88 has a front cylinder end 91 and a rear cylinder end 92. The rear cylinder end preferably attaches to the thumb mount frame 29 at the rear frame end 32 of the thumb mount frame. Most preferably the rear cylinder end attaches to the thumb mount frame at a rear frame link 94 that interconnects the first rear frame end 37 of the first frame plate 33, to the second rear frame end 39 of the second frame plate 34. The front cylinder end attaches to the thumb 28. Most preferably, the front cylinder end attaches to the thumb at a thumb bracket 95, preferably located on at least one of the thumb plate links 74, as shown in FIG. 8.

Figure 11:
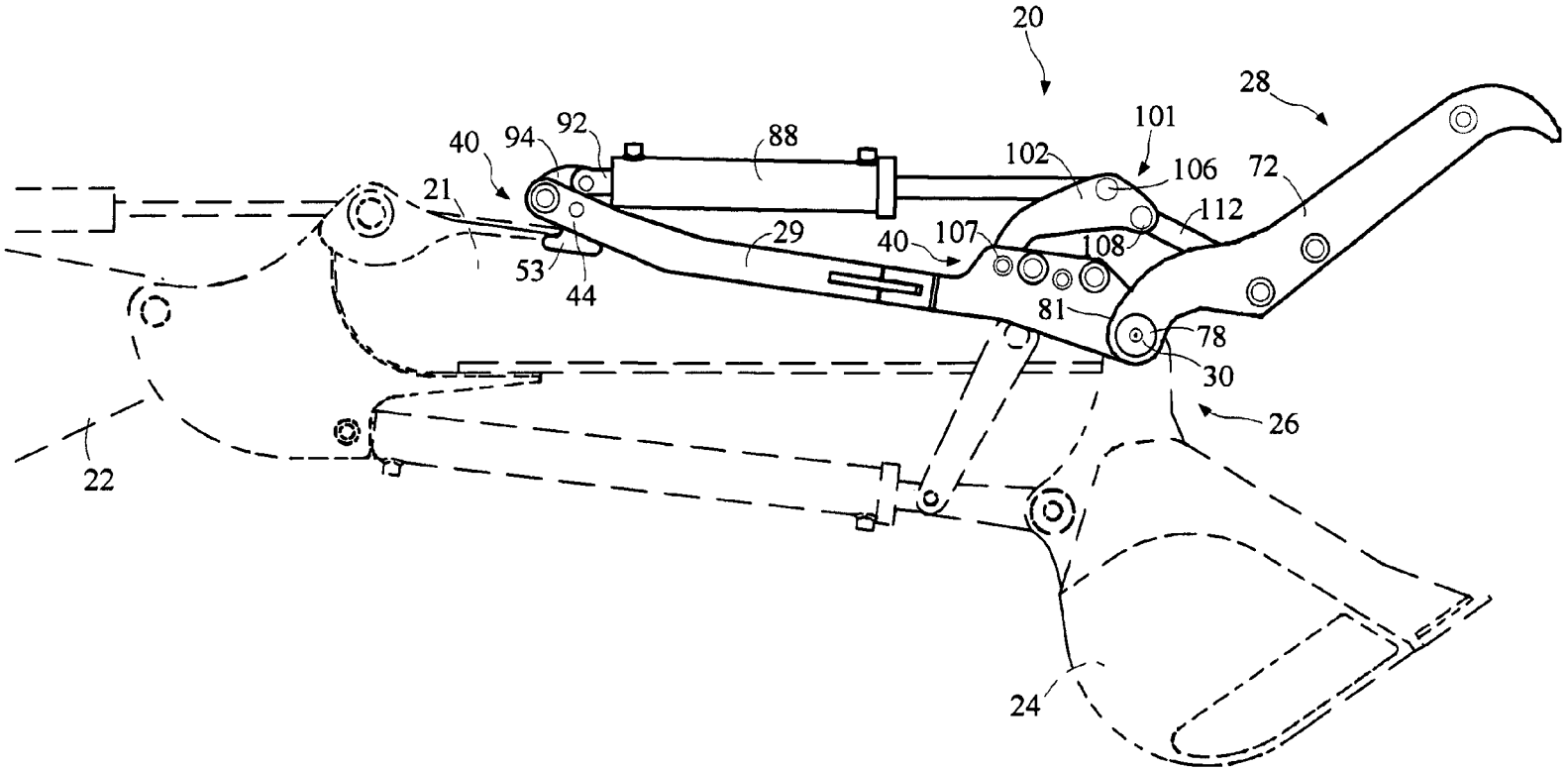
FIG. 11 is a side view of a thumb apparatus, according to an embodiment of the invention.

In an alternative embodiment of the present invention, as shown in FIGS. 11 and 12, the rear cylinder end 92 of the thumb cylinder 88 also attaches to the thumb mount frame 29 at the rear frame link 94. However in this alternative embodiment, which is preferable in instances where the size of the thumb apparatus 20 and clearances from the boom member 21 require, the front cylinder end can attach to a bell crank 101. Most preferably, a two part bell crank, having a first crank plate 102 and a second crank plate 103, are utilized to effectively sandwich the front cylinder end 91. The bell crank, and so each bell crank plate, includes a cylinder pivot 106, a frame pivot 107 and a link pivot 108. The cylinder pivot of the bell crank hingably receives the front cylinder end between the first and second crank plates. The frame pivot of the bell crank hingably mounts to the front mounting bracket 56 of the thumb mount frame 29 at a crank flange 110. Like the front cylinder end, the first and second crank plate sandwich the crank flange. The link pivot of the bell crank hingably mounts to a thumb link 112, which connects the bell crank to the thumb bracket 95, preferably located on at least one of the thumb plate links 74 of the thumb 28. Like the front cylinder end, the first and second crank plate sandwich the thumb link. The thumb cylinder rotates the bell crank about the frame pivot and so forces the thumb link to actuate the thumb. This alternative feature of the thumb apparatus serves to maintain distance from the thumb cylinder and the thumb mount frame upon full extension of the thumb cylinder.

To prevent the first crank plate 102 and the second crank plate 103 from "walking" or acting independently, a retainer block 115 is preferably employed on each crank plate as shown in FIG. 12. A cylinder crank pin 116 is preferably employed to connect the first and second crank plate at the cylinder pivot 106. The cylinder crank pin receives a retainer block at each end, to prevent rotation of the cylinder crank pin. Likewise, a frame crank pin 117 is preferably employed to connect the first and second crank plate at the frame pivot 107. The frame crank pin receives a retainer block at each end, to prevent rotation of the frame crank pin. Also similarly, a link crank pin 118 is preferably employed to connect the first and second crank plate at the link pivot 108. The link crank pin receives a retainer block at each end to, prevent rotation of the link crank pin.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A thumb apparatus for use with heavy equipment, the thumb apparatus co-operatively actuated with a bucket, the thumb apparatus comprising:

a thumb hingably attached to a thumb mount frame at a thumb pivot, the thumb mount frame having a detachable mount to a heavy equipment boom member;

the thumb pivot including a first thumb pivot and a second thumb pivot, the first thumb pivot hingable about a thumb pivot axis, and the second thumb pivot hingable about the thumb pivot axis;

the bucket pivotable about the heavy equipment boom member at a bucket pivot, the bucket pivot hingable about a bucket pivot axis, the bucket pivot having a bucket pin and the bucket pin separate from the thumb pivots; and the thumb pivot axis closely lines-up with the bucket pivot axis, to hinge the thumb and the bucket approximately about the same axis.

2. The thumb apparatus of the claim 1, wherein the bucket pivot is positioned between the first thumb pivot and second thumb pivot.

3. The thumb apparatus of the claim 1, additionally wherein:

the thumb mount frame includes a first frame plate and a second frame plate; and the first frame plate and the second frame plate mount to the heavy equipment boom member, the first frame plate positioned opposite the second frame plate, about the heavy equipment boom member.

4. The thumb apparatus of the claim 1, additionally wherein:

the thumb includes a first thumb plate and a second thumb plate, the first thumb plate and the second thumb plate interconnected by a thumb plate link; and the first thumb plate and the second thumb plate held in a parallel relationship to each other by the thumb plate link.

5. The thumb apparatus of the claim 4, additionally wherein:

the first thumb pivot comprises a hinged attachment of the first thumb plate to the first frame plate, proximate to a first front frame end of the first frame plate; and the second thumb pivot comprises a hinged attachment of the second thumb plate to the second frame plate, proximate to a second front frame end of the second frame plate.

6. The thumb apparatus of the claim 5, wherein the thumb pivot axis of the first thumb pivot and the thumb pivot axis of the second thumb pivot collocates with the bucket pivot axis of the bucket pivot.

7. The thumb apparatus of the claim 6, wherein the first thumb pivot and the second thumb pivot straddle the bucket pivot.

8. The thumb apparatus of the claim 7, wherein;

the thumb actuates about the thumb pivot by action of a thumb cylinder, the thumb cylinder comprising an actuated piston and cylinder combination.

9. The thumb apparatus of the claim 1, wherein the bucket includes an heavy equipment attachment consisting of a scoop, a finger or a grapple.

10. A thumb apparatus for use with heavy equipment, the thumb apparatus co-operatively actuated with a bucket, the thumb apparatus comprising:

a thumb hingably attached to a thumb mount frame at a thumb pivot, the thumb mount frame having a detachable mount to a heavy equipment boom member;

the thumb pivot including a first thumb pivot and a second thumb pivot, the first thumb pivot hingable about a thumb pivot axis, and the second thumb pivot hingable about the thumb pivot axis;

the bucket pivotable about the heavy equipment boom member at a bucket pivot, the bucket pivot hingable about a bucket pivot axis, the bucket pivot positioned between the first thumb pivot and second thumb pivot;

and the bucket pivot having a bucket pin, the bucket pin separate from first the thumb pivot and the second thumb pivot; and the thumb pivot axis lines-up with the bucket pivot axis, and the bucket pivot axis is the same as the thumb thumb pivot axis.

11. The thumb apparatus of the claim 10, additionally wherein:

the thumb mount frame includes a first frame plate and a second frame plate; and the frame plate and the second frame plate mount to the heavy equipment boom member, the first frame plate positioned opposite the second frame plate, about the heavy equipment boom member.

12. The thumb apparatus of the claim 11, additionally wherein:

the thumb includes a first thumb plate and a second thumb plate, the first thumb plate and the second thumb plate interconnected by a thumb plate link; and the first thumb plate and the second thumb plate held in a parallel relationship to each other by the thumb plate link.

13. The thumb apparatus of the claim 12, additionally wherein:

the first thumb pivot comprises a hinged attachment of the first thumb plate to the first frame plate, proximate to a first front frame end of the first frame plate;

the second thumb pivot comprises a hinged attachment of the second thumb plate to the second frame plate, proximate to a second front frame end of the second frame plate; and the thumb pivot axis of the first thumb pivot lines-up with the bucket pivot axis of the bucket pivot and the bucket pivot axis is the same as the thumb thumb pivot axis, and the thumb pivot axis of the second thumb pivot lines-up with the bucket pivot axis of the bucket pivot and the bucket pivot axis is the same as the thumb thumb pivot axis.

14. The thumb apparatus of the claim 13, wherein the first thumb pivot and the second thumb pivot straddle the bucket pivot.

15. The thumb apparatus of the claim 10, wherein;

the thumb actuates about the thumb pivot by action of a thumb cylinder, the thumb cylinder comprising an actuated piston and cylinder combination.

16. The thumb apparatus of the claim 10, wherein the bucket includes an heavy equipment attachment consisting of a scoop, a finger or a grapple.

17. A method of detachably mounting and operating a co-operatively actuating thumb apparatus to a heavy equipment boom member comprising the steps of:

a) providing a thumb mount frame with a detachable mount;

b) hingably attaching a thumb to the thumb mount frame at a thumb pivot, the thumb pivot including a first thumb pivot and a second thumb pivot, the first thumb pivot hingable about a thumb pivot axis, and the second thumb pivot hingable about the thumb pivot axis;

c) mounting the detachable mount to the heavy equipment boom member;

d) providing a bucket, the bucket pivotable about the heavy equipment boom member at a bucket pivot, the bucket pivot hingable about a bucket pivot axis, and the bucket pivot having a bucket pin, the bucket pin separate from the thumb pivot;

e) collocating the thumb pivot axis with the bucket pivot axis, to line-up the thumb pivot axis with the bucket pivot axis; and f) hinging the thumb on the same axis as the bucket.

18. The method of claim 17, additionally including the steps of:

g) providing the detachable mount with a mounting ear;

h) welding the mounting ear to the boom member;

i) providing the thumb mount frame with a mounting bracket; and j) inserting a mounting pin into the mounting bracket to engage the mounting ear.

19. The method of claim 18, additionally including the steps of:

k) extracting the mounting pin from the mounting bracket to disengage the mounting ear from the mounting bracket; and l) removing the detachable mount from the heavy equipment boom member.

* * * * *